US006923006B2

(12) United States Patent
Walton et al.

(10) Patent No.: US 6,923,006 B2
(45) Date of Patent: Aug. 2, 2005

(54) GASSED LIQUID DISPENSERS

(76) Inventors: Philip Andrew Walton, Ebac Limited, St. Helen Trading Estate, Bishop Auckland, Durham, DL14 9AL (GB); Gary Squire, Ebac Limited, St. Helen Trading Estate, Bishop Auckland, Durham, DL14 9AL (GB); Robert Tansley, Warwick Design Consultants, 12 Waterloo Park Estate, Bidford upon Avon, Warwickshire, B50 4JH (GB); Andrew Gibbs, Warwick Design Consultants, 12 Waterloo Park Estate, Bidford upon Avon, Warwickshire, B50 4JH (GB)

( * ) Notice: Subject to any disclaimer, the term of this patent is extended or adjusted under 35 U.S.C. 154(b) by 435 days.

(21) Appl. No.: 10/297,037

(22) PCT Filed: Dec. 19, 2001

(86) PCT No.: PCT/GB01/05649

§ 371 (c)(1),
(2), (4) Date: Nov. 27, 2002

(87) PCT Pub. No.: WO02/051739

PCT Pub. Date: Jul. 4, 2002

(65) Prior Publication Data

US 2003/0177784 A1 Sep. 25, 2003

(30) Foreign Application Priority Data

Dec. 23, 2000 (GB) ..... 0031627

(51) Int. Cl.[7] ..... F25B 21/02

(52) U.S. Cl. ..... 62/3.64; 62/389; 222/146.6; 222/400.7

(58) Field of Search ..... 62/3.2, 3.62, 389, 62/600, 393; 222/146.6, 399, 400.7, 129.1

(56) References Cited

U.S. PATENT DOCUMENTS

| | | | | | |
|---|---|---|---|---|---|
| 4,299,091 | A | * | 11/1981 | Carter et al. | 62/48.1 |
| 4,861,560 | A | * | 8/1989 | Nakajima | 422/111 |
| 5,192,513 | A | * | 3/1993 | Stumphauzer et al. | 422/305 |
| 5,310,088 | A | * | 5/1994 | Burrows | 222/67 |
| 5,324,424 | A | * | 6/1994 | Hochgatterer | 210/123 |
| 5,366,619 | A | * | 11/1994 | Matsui et al. | 210/139 |
| 5,556,006 | A | * | 9/1996 | Sano | 222/129.1 |
| 5,833,096 | A | * | 11/1998 | Ohu | 222/146.1 |
| 5,868,944 | A | * | 2/1999 | Wright et al. | 210/758 |
| 5,975,365 | A | * | 11/1999 | Hsieh | 222/129.4 |
| 6,197,189 | B1 | * | 3/2001 | Schwartz et al. | 210/192 |
| 6,641,723 | B2 | * | 11/2003 | Crowley et al. | 210/198.1 |

FOREIGN PATENT DOCUMENTS

GB 2133088 A * 7/1984

* cited by examiner

*Primary Examiner*—William E. Tapolcai
*Assistant Examiner*—Mohammad M. Ali
(74) *Attorney, Agent, or Firm*—Ira S. Dorman

(57) ABSTRACT

Water supplied from a bottle 1 is pre-chilled in a reservoir 3. A two-part water pump 11 transfers water under pressure through a jet nozzle 14 into an oxygen space 17 in a PET pressure vessel 12, which entrains oxygen into the water. The pressure vessel is received in a conductive holder 18 and is cooled by a peltier element 19 provided with cooling fins 20. The holder 18 forms a capacitive level sensor with a probe 32 inside the vessel, which starts the pump 11 when oxygenated water is drawn off via a draw tube 28 and discharge valve 31. When the water level in the oxygenating vessel is restored a solenoid valve 25 opens to restore the oxygen pressure in the vessel. For hygiene purposes the pumping body can be removed from the pump motor and replaced together with the reservoir 3 and oxygenating vessel 12 along with the associated tubing.

10 Claims, 2 Drawing Sheets

GASSED LIQUID DISPENSERS

TECHNICAL FIELD OF THE INVENTION

This invention relates to dispensers for gassed liquids, e.g. oxygenated water.

BACKGROUND

EP 0 581 491 A describes a water dispenser having a housing which supports an inverted bottle. A feed tube projects upwardly into the neck of the bottle through which water discharges under gravity into a reservoir in the form of a flexible bag. Water is chilled in the reservoir before being dispensed from a discharge outlet which incorporates a manually operable valve. For hygienic purposes the feed tube is incorporated in a unit which can be removed together with the bag and the associated tubing for replacement during a maintenance operation.

Whilst most bottled water dispensers provide still (ungassed) water there is a growing demand for water which has been oxygenated. Drinking water with an increased level of dissolved oxygen is believed by some to provide health benefits and generally enhance body functions.

Known oxygenating water coolers have a fixed reservoir in which oxygen is bubbled through the water. The reservoir must be of a considerable size in order to maximise the contact area between the oxygen bubbles and the water, and the reservoir is prone to bacterial contamination. Such oxygenating techniques require a large amount of oxygen which is usually supplied from an in-built oxygen generator, which further increases the size and complexity of the apparatus. Furthermore, the dispensed water does effervesce very freely so that it has the appearance of being flat compared with fizzy carbonated drinks with which most people are familiar.

The present invention seeks to provide a new and inventive form of gassed liquid dispenser which is hygienic to use, is relatively small and compact, and offers efficient use of gas whilst providing a highly effervescent or fizzy product.

SUMMARY OF THE INVENTION

The present invention proposes a gassed liquid dispenser which includes:

- a liquid reservoir arranged to receive liquid from a liquid source and provided with means for chilling the liquid therein;
- a pressure vessel containing a liquid space and a gas space above the liquid space, a gas inlet, a liquid injector nozzle in the gas space, and a liquid outlet from the liquid space;
- cooling means for cooling liquid in the pressure vessel;
- a gas supply arranged to supply a charge of pressurised gas to the pressure vessel through the gas inlet;
- a discharge outlet for dispensing pressurised liquid received from said liquid outlet; and
- pump means for transferring chilled liquid from the reservoir to the injector nozzle under pressure whereby chilled liquid is injected into the gas space characterised in that the pressure vessel is removably received in the cooling means whereby both the pressure vessel and the reservoir can be replaced.

By pre-chilling the liquid and injecting it under pressure into a charge of pressurised gas the liquid becomes supercharged with dissolved gas. Thus, when the liquid is dispensed the gas quickly comes out of solution appearing as large gas bubbles. Furthermore, the volume of the reservoir can be relatively small and usage of gas is relatively low. Since the gassed liquid dispenser of the present invention can operate very efficiently at a relatively low pressure the pressure vessel can be provided by an inexpensive disposable plastics container which can be replaced together with the reservoir in the course of a maintenance operation.

A preferred form of pump means comprises a fixed motor section and a disposable pump body.

Preferably control means is provided to operate the pump means. The control means is preferably also arranged to operate a gas valve to supply a charge of gas to the pressure vessel. The charge of gas is preferably introduced when the pump means is not operating to avoid venting undissolved gas through the discharge outlet.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
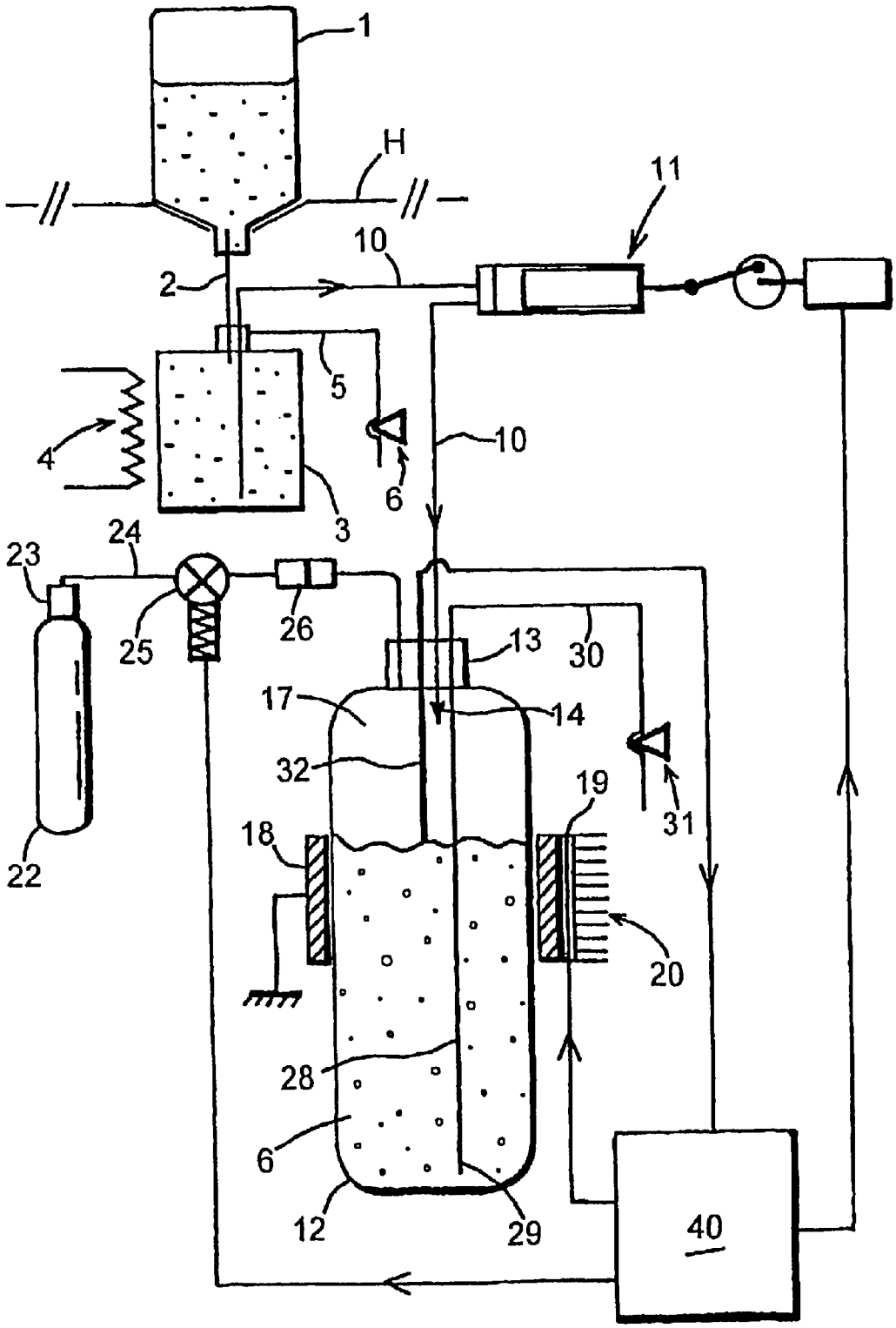
FIG. 1 is a is a schematic drawing showing the internal components of an oxygenated water cooler in accordance with the invention.

The water cooler has a housing H which provides a seat for receiving an inverted water bottle 1. Water passes through the neck of the bottle 1 and travels via a tube 2 to a reservoir 3 formed by a plastics container which is removably received within the refrigeration coils 4 of a conventional refrigeration system. If required, chilled still water can be drawn from the reservoir via tubing 5 and a discharge outlet 6 which incorporates a manually-operable pinch valve. Since this portion of the water cooler is conventional it will not be described in greater detail.

Chilled water may also be taken from the reservoir via a transfer tube 10 which leads via a positive displacement pump 11 (described below) to an oxygenating pressure vessel 12. The oxygenating vessel is generally cylindrical and is moulded from PET or other plastics similar to a fizzy drinks bottle. The tube 10 enters the vessel 12 through a top closure 13 ending at an injector nozzle 14 at the top of the vessel. The bottom part of the vessel normally contains water 16 with a gas space 17 formed in the upper portion. The oxygenating vessel is received in an aluminum or other heat-conducting holder 18 which embraces the mid region of the vessel at the top of the water space 16. A peltier element 19 is sandwiched between the holder 18 and a finned heat sink 20 to cool water in the oxygenating vessel.

The gas space 15 is charged with oxygen from a cylinder 22 provided with a pressure regulator 23. Oxygen passes through a supply pipe 24 via a normally-closed solenoid valve 25 and an in-line connector 26, again entering the top of the oxygenating vessel through the closure 13. A draw tube 28 provides a water outlet 29 adjacent to the bottom of the vessel to conduct oxygenated water through the closure 13 and a tube 30 to an oxygenated water outlet 31 for which includes a manually-operable pinch valve.

The level of water in the oxygenating vessel is determined by a probe 32 which is inserted through the closure 13 to form one electrode of a capacitive sensor, the other electrode being formed by the holder 18. When the discharge valve 31 is opened the charge of pressurised oxygen in the vessel 12 causes oxygenated water to issue from the discharge outlet 31. The resulting reduction in water level within the vessel is detected by the probe 32 which signals an electronic control system 40 to start the pump 11. This causes a high speed jet of pre-chilled water to enter the gas space 17 through the nozzle 14 which causes considerable turbulence as the jet impacts on the surface of the water remaining in the oxygenating vessel. The jet of water simultaneously entrains oxygen into the water so that it becomes supersaturated with dissolved oxygen.

If desired the surface area of the water can be increased by a further 50% if the oxygenating vessel is tilted, thereby attaining a further increase in the oxygenation level.

When the valve 31 is closed the pump continues to jet water into the vessel 12 until the probe 32 detects a change in capacitance as the water level reaches the probe. The control system 40 then turns off the pump, following which the solenoid valve 25 is opened for a short period to admit a further charge of oxygen into the gas space 17.

Pre-chilling of water in the reservoir 3 ensures that the water is in the best condition to absorb high levels of oxygen as soon as it enters the oxygenating vessel. The peltier cooler 18, 19, 20 ensures that the oxygenated water can be accurately maintained at a suitable temperature for minimum depletion of dissolved oxygen before being dispensed.

Although the volume of the oxygenating vessel and the gas pressure are small the oxygen saturation level in the dispensed water is very high. Indeed, the dispensed water is generally highly effervescent, having the appearance of fresh carbonated drinks.

The gas pressure set by the regulator 23 and the volume of water in the reservoir 12 are set such that if the pump fails to function when the valve 31 is opened (e.g. due to a power failure) the gas pressure in the vessel will drop to atmospheric pressure before the outlet opening is uncovered. Delivery of water will therefore cease without risk of discharging oxygen gas into the atmosphere. In fact, under normal conditions all of the oxygen supplied by the cylinder 22 will become dissolved in water with little or no waste.

Figure 2:
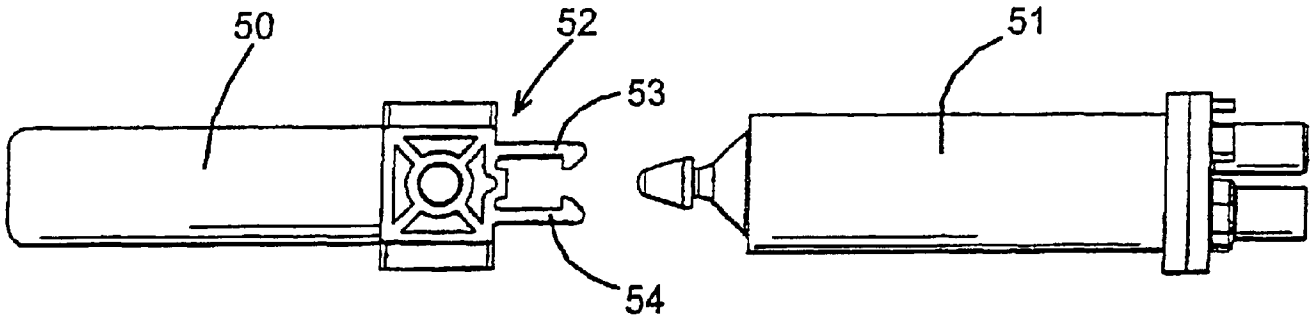
FIG. 2 is a side view of a water pump for use in the dispenser.
Figure 3:
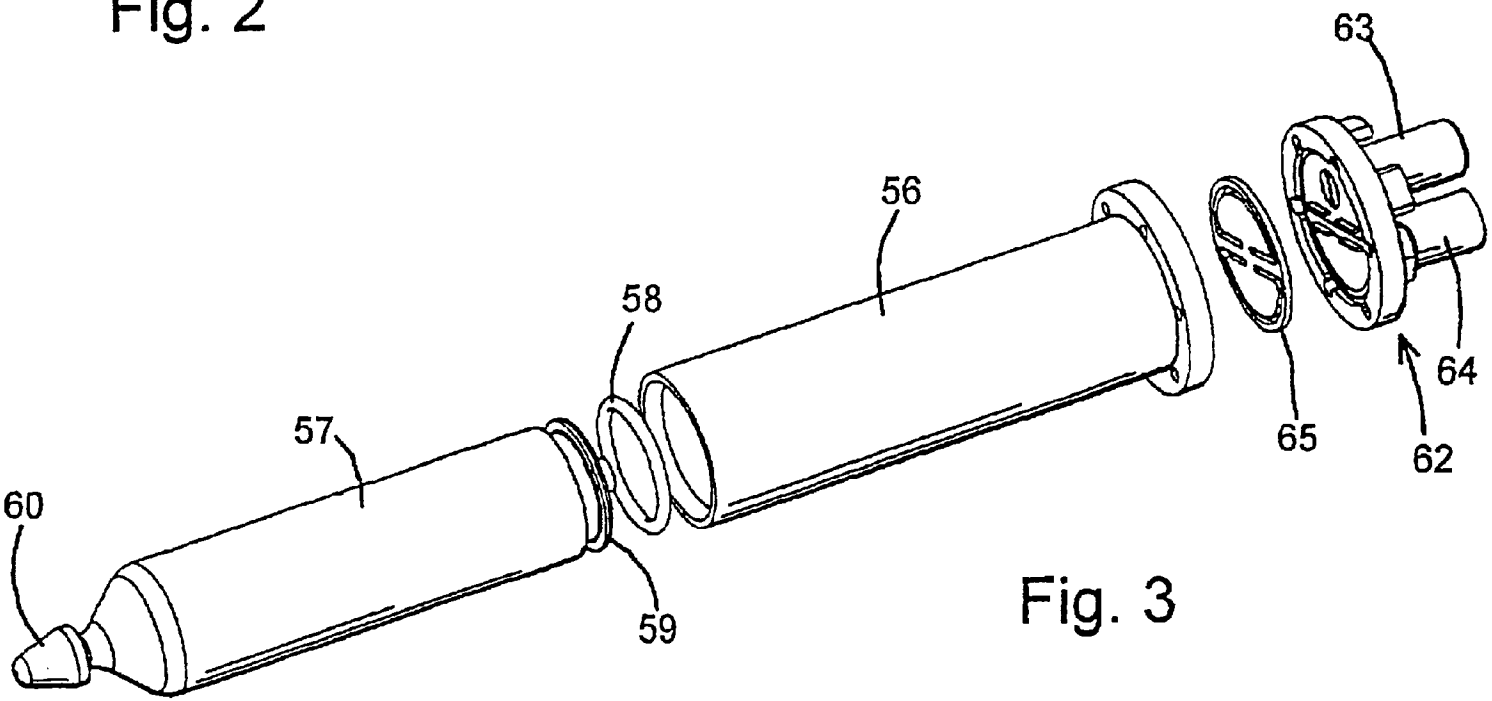
FIG. 3 is an exploded perspective view of the replaceable section of the pump.

The water pump which is shown in FIG. 2 includes a fixed motor section 50 and a separable pumping section 51. The section 50 contains an electric motor which reciprocally moves a gripper 52 by means of an eccentric. The gripper has a pair of spaced resilient pickup arms 53 and 54 with inturned ends. The pumping section 51, also shown in exploded detail in FIG. 3, includes a cylinder 56 containing a piston 57 which carries an O-ring seal 58 within a groove 59. The piston has an arrowhead-section coupling 60 which projects from one end of the cylinder 56 while the opposite end of the cylinder has a head unit 62 incorporating inlet and outlet couplers 63 and 64. A disc-shaped flap valve 65 is mounted on the inner face of the head to ensure that water can only flow through the cylinder in one direction. Thus, when the gripper 52 is engaged with the coupling 60 the motor unit moves the piston to draw water into the cylinder through the inlet coupler 63 and then expels it through the outlet port 64 upon movement in the reverse direction.

During routine maintenance of the water cooler the reservoir 3, oxygenating vessel 12 and the associated tubing can be removed and replaced with clean components. The oxygen supply is disconnected at the quick release coupling 26. At the same time, the pumping section 51 of the water pump 11 can be disconnected from the gripper 52 and replaced. The resilient arms 53 and 54 of the gripper move over the coupling 60 to ensure that the piston is automatically engaged when the motor operates. The feed tube 2 is included in a removable manifold unit which can be replaced with the reservoir 3 as disclosed in EP 0 581 491 A, the disclosure of which is incorporated herein by reference. Since all of the surfaces which come into contact with water are renewed, complete hygiene can be maintained in the water cooler.

Other forms of pump could be used for transferring the chilled water from the reservoir 3 to the pressure vessel 12, for example a diaphragm pump or a wobble plate pump which has been modified to include a fixed motor section and a replaceable pumping section.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. A gassed liquid dispenser which includes:

a liquid reservoir arranged to receive liquid from a liquid source and provided with means for chilling the liquid therein;

a pressure vessel containing a liquid space and a gas space above the liquid space, a gas inlet, a liquid injector nozzle in the gas space, and a liquid outlet from the liquid space;

cooling means for cooling liquid in the pressure vessel;

a gas supply arranged to supply a charge of pressurised gas to the pressure vessel through the gas inlet;

a discharge outlet for dispensing pressurised liquid received from said liquid outlet; and pump means for transferring chilled liquid from the reservoir to the injector nozzle under pressure whereby chilled liquid is injected into the gas space characterised in that the pressure vessel is removably received in the cooling means whereby both the pressure vessel and the reservoir can be replaced.

2. A gassed liquid dispenser according to claim 1, in which the pump means includes a fixed motor section and a disposable pump body which can be disconnected from the motor section and replaced with the pressure vessel and the reservoir.

3. A gassed liquid dispenser according to claim 2, in which the pump body has a pumping chamber which contains a liquid displacement member having a releasable coupling with the motor section.

4. A gassed liquid dispenser according to claim 3, in which the pump body includes valve means for producing a unidirectional flow of liquid through the pumping chamber.

5. A gassed liquid dispenser according to claim 1, in which control means is provided to operate the pump means.

6. A gassed liquid dispenser according to claim 5, in which the control means is arranged to operate the pump means in response to removal of liquid from the pressure vessel which is detected by sensing the capacitance between a first electrode inside vessel and a second electrode outside vessel.

7. A gassed liquid dispenser according to claim 5, in which the control means is arranged to operate a gas valve to supply a charge of gas to the pressure vessel when the pump means is not operating.

8. A gassed liquid dispenser according to claim 1, in which the liquid is water and the gas is oxygen.

9. A gassed liquid dispenser according to claim 1, in which the liquid source includes a bottle.

10. A gassed liquid dispenser which includes:

a liquid reservoir arranged to receive liquid from a liquid source and provided with means for chilling the liquid therein;

a pressure vessel containing a liquid space and a gas space above the liquid space, a gas inlet, a liquid injector nozzle in the gas space, and a liquid outlet from the liquid space;

cooling means for cooling liquid in the pressure vessel;

a gas supply arranged to supply a charge of pressurised gas to the pressure vessel through the gas inlet;

a discharge outlet for dispensing pressurised liquid received from said liquid outlet;

pump means for transferring chilled liquid from the reservoir to the injector nozzle under pressure whereby chilled liquid is injected into the gas space; and control means arranged to operate the pump means;

characterised in that the control means is arranged to operate a gas valve to supply a charge of gas to the pressure vessel when the pump means is not operating.

* * * * *